US007212757B2

(12) United States Patent
Kudou et al.

(10) Patent No.: US 7,212,757 B2
(45) Date of Patent: May 1, 2007

(54) IMAGE PRINTING METHOD AND APPARATUS

(75) Inventors: Tomoo Kudou, Tokyo (JP); Fusako Akimoto, Tokyo (JP); Hiroyuki Arai, Tokyo (JP)

(73) Assignee: Konica Minolta Holdings, Inc., Tokyo (JP)

( * ) Notice: Subject to any disclaimer, the term of this patent is extended or adjusted under 35 U.S.C. 154(b) by 436 days.

(21) Appl. No.: 10/806,814

(22) Filed: Mar. 22, 2004

(65) Prior Publication Data

US 2004/0202489 A1 Oct. 14, 2004

(30) Foreign Application Priority Data

Mar. 25, 2003 (JP) ..... 2003-083201

(51) Int. Cl.
*G03G 15/16* (2006.01)

(52) U.S. Cl. ..... 399/66; 399/301; 399/49

(58) Field of Classification Search ..... 399/66, 399/301, 49, 82

See application file for complete search history.

(56) References Cited

U.S. PATENT DOCUMENTS 6,243,542 B1 * 6/2001 Fujimoto et al. ..... 399/49
6,973,272 B2 * 12/2005 Yamamoto et al. ..... 399/301 X
2003/0133000 A1 * 7/2003 Conrow et al. ..... 347/116

FOREIGN PATENT DOCUMENTS

| | | | |
|---|---|---|---|
| JP | 62164037 A | * | 7/1987 |
| JP | 06-289681 | | 10/1994 |
| JP | 2002-072771 A | | 3/2002 |
| JP | 2002-258680 A | | 9/2002 |

* cited by examiner

*Primary Examiner*—David M. Gray
*Assistant Examiner*—Erika J. Villaluna
(74) *Attorney, Agent, or Firm*—Frishauf, Holtz, Goodman & Chick, P.C.

(57) ABSTRACT

This invention provides an image printing method and apparatus which accurately correct the read timing of a sensor system used to correct the position of a toner image in the correction operation mode, and accurately corrects the magnification of an image in the vertical direction in the print operation mode. An image printing apparatus according to the invention includes an image printing unit which prints a toner image on an intermediate transfer belt, and a control unit which controls the rotational speed of the intermediate transfer belt by detecting a toner image printing on the intermediate transfer belt by the image printing unit. When the correction operation mode is selected, the control unit executes feedback control on the rotational speed of the intermediate transfer belt on the basis of vertical magnification adjustment value data. When the print operation mode is selected, the control unit executes feedback control on the rotational speed of the intermediate transfer belt on the basis of vertical magnification adjustment value.

7 Claims, 9 Drawing Sheets

FIG. 2A
PRIOR ART
FIG. 2B
PRIOR ART
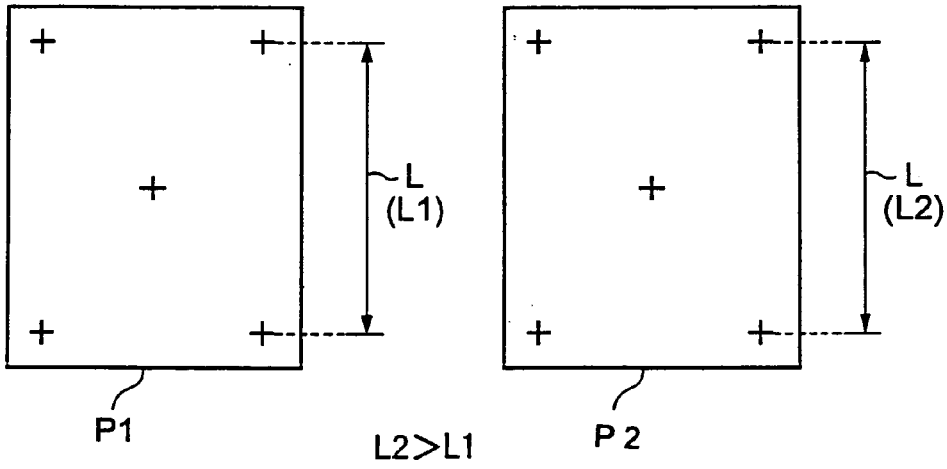
FIG. 3A
PRIOR ART
FIG. 3B
PRIOR ART
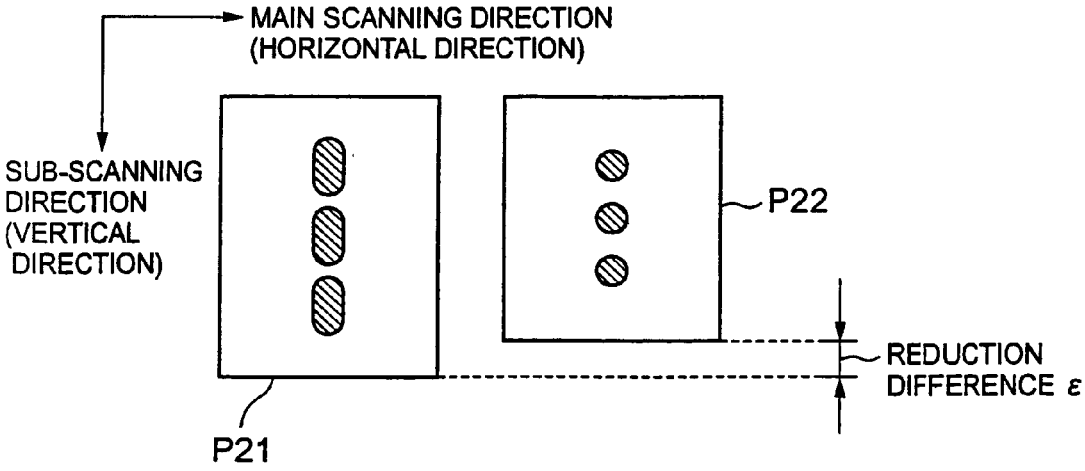

A: DISTANCE (mm) FROM EXPOSURE POINT ON DRUM TO SENSOR 11

B: DISTANCE (mm) BETWEEN SENSOR 11 AND SENSOR 12

Ta: TIME (sec) MEASURED WHEN CORRECTION IS MADE BY SENSOR 11

LS: SPEED (mm/sec) OF DRUM/INTERMEDIATE TRANSFER MEMBER

IMAGE PRINTING METHOD AND APPARATUS

BACKGROUND OF THE INVENTION

1. Field of the Invention

The present invention relates to an image printing method and apparatus which can be suitably applied to a color digital copying machine, multifunction apparatus, and the like which print a color image based on color image information and output it.

2. Description of the Prior Art

Recently, a color image printing apparatus has been put into practice, which is designed to print a color image on the basis of red (R), green (G), and blue (B) image data acquired from a colored original image or receive image data from a printer controller (external apparatus) such as a server or personal computer (to be simply referred to as a PC hereinafter) to print a color image on the basis of the image data. A color image printing apparatus of this type is disclosed in Japanese Unexamined Patent Publication No. 2002-72771 (see pp. 14–25 and FIG. 5 of this reference).

FIG. 1 is a block diagram showing the schematic arrangement of a conventional color image printing apparatus 200. The color image printing apparatus 200 shown in FIG. 1 has a control unit 15. A color registration sensor 11, density (to be referred to as Dmax hereinafter) sensor 12, timer unit 13, counter unit 16, image printing unit 18', and nonvolatile memory 36 are connected to the control unit 15. The image printing unit 18' has an intermediate transfer belt 6 and convey driving unit 28. When a yellow (to be referred to as Y hereinafter) image printing unit is to be formed, the image printing unit 18' includes a photosensitive drum 1Y, charging unit 2Y, exposure unit 3Y, developing unit 4Y, and the like for Y. Although not shown, this apparatus also includes magenta (to be simply referred to as M hereinafter), cyan (to be simply referred to as C hereinafter), and black (to be simply referred to as BK hereinafter) image printing units. The convey driving unit 28 drives the intermediate transfer belt 6 and photosensitive drum 1Y on the basis of a convey driving signal S4'. The convey driving signal S4' is, for example, a signal which is corrected by a signal for adjusting the magnification of an image in the vertical direction. This signal is output from the control unit 15 to the convey driving unit 28.

In the image printing unit 18', when the photosensitive drum 1Y is charged by the charging unit 2Y, the exposure unit 3Y irradiates the photosensitive drum 1Y with a laser beam having a predetermined intensity based on image printing data DOUT. As a result of this write processing, an electrostatic latent image is printed on the photosensitive drum 1Y. This electrostatic latent image is developed by the developing unit 4Y with Y toner. The Y image developed with this Y toner is transferred onto the intermediate transfer belt 6. Toner images of the respective colors are superposed into a color image on the intermediate transfer belt 6. The color image is transferred from the intermediate transfer belt 6 onto a paper sheet (not shown). This image is then fixed by the fixing unit (see Japanese Unexamined Patent Publication No. 2002-72771).

FIGS. 2A and 2B are views showing an example (first example) of vertical magnification adjustment for a toner image in the color image printing apparatus 200. In the correction image patterns shown in FIGS. 2A and 2B, the "+" symbols constitute a pattern for detecting the reduction of an image in the vertical direction (the sub-scanning direction in image printing). In this example, the "+" symbols are arranged in quincunxes.

A length L between the "+" symbols of a correction image pattern P1 shown in FIG. 2A which is expected by the control system should be equal to a length between the "+" symbols of a correction image pattern P2 shown in FIG. 2B which is actually printed on a paper sheet by the image printing system. However, image reduction occurs depending on the type or size of paper sheet. For example, in some case, a length L2 between the "+" symbols of the correction image pattern P2 actually printed on a paper sheet by the image printing system becomes larger than a length L1 between the "+" symbols of the correction image pattern P1 expected by the control system (L2>L1). For this reason, the vertical magnification of a toner image must be adjusted in accordance with the type or size of paper sheet.

Each of Japanese Unexamined Patent Publication Nos. 2002-258680 (see p. 3 and FIG. 2) and 06-289681 (see p. 2 and FIG. 2) discloses an image printing apparatus having a photosensitive drum changing function.

FIGS. 3A and 3B are views showing another example (second example) vertical magnification adjustment for a toner image in the color image printing apparatus 200 of this type. The elliptic hatched portions of an image print example P21 shown in FIG. 3A are a toner image printed on the intermediate transfer belt 6. In this example, three elliptic hatched portions are printed side by side in the direction (sub-scanning direction) in which the intermediate transfer belt 6 moves. In an image print example P22 shown in FIG. 3B, the circular hatched portions are obtained by transferring the toner image constituted by the elliptic hatched portions printed on the intermediate transfer belt 6 onto a paper sheet having a predetermined paper quality and size, and fixing the image. The image shown in FIG. 3B is a target image constituted by circular hatched portions.

When an image constituted by circular hatched portions is to be obtained on a paper sheet having a predetermined paper quality and size, the intermediate transfer belt 6 is controlled to increase its rotational speed on the basis of a vertical magnification adjustment value obtained in advance. With this operation, as shown in FIG. 3A, elliptic hatched portions are printed with respect to circular hatched portions expected by the control system. This makes it possible to adjust a reduction difference A between the image print example P21 and the image print example P22. In general, as the rotational speed of the intermediate transfer belt 6 is increased, an image is enlarged, and vice versa (see Japanese Unexamined Patent Publication Nos. 2002-258680 and 06-289681).

FIG. 4 is a flow chart showing an example of the operation of the conventional color image printing apparatus 200. According to the color image printing apparatus 200, a correction operation mode and print operation mode are prepared in advance. In the correction operation mode, a toner image is printed on the intermediate transfer belt 6 to correct the image printing system. In the print operation mode, the image printing system is operated to print an image on a paper sheet.

In the conventional color image printing apparatus 200, in step B1 in the flow chart shown in FIG. 4, control information is input (output) to the control unit 15. This control information is used to determine the necessity of the correction operation mode, and includes operating time data D7 and image printing count data D8 of the image printing unit 18'. The flow then advances to step B2, in which the control unit 15 outputs the convey driving signal S4' to the convey driving unit 28 to rotate the intermediate transfer belt 6, the photosensitive drum 1Y, registration rollers 23, a fixing roller, and the like at rotational speeds set in consideration of a vertical magnification adjustment value.

In step B3, the control unit 15 checks whether the correction operation mode or the print operation mode is selected. In this case, the control unit 15 reads out a control target value DR from the nonvolatile memory 36, and compares the operating time data D7 obtained from the timer unit 13 with the control target value DR.

If the comparison result indicates that the operating time of the image printing unit 18' exceeds the control target value DR, the correction operation mode is selected. The flow then advances to step B4 to execute correction operation. In the correction operation mode, the control unit 15 corrects a color registration positional shift, corrects the read timing of the Dmax sensor 12, or measures the density of a correction image on the intermediate transfer belt 6 using the Dmax sensor 12 after correction. On the basis of this measurement result, for example, the control unit 15 corrects the amount of charging by the charging unit 2Y for the Y image printing system or the laser power (Y laser) in the exposure unit 3Y. The flow then advances to step B7. Similar corrections are made for the remaining M, C, and BK image printing systems.

If the print operation mode is selected in step B3, the flow advances to step B5, in which the control unit 15 executes the print operation mode. In the image printing unit 18', when the photosensitive drum 1Y is charged by the charging unit 2Y, the exposure unit 3Y irradiates the charged photosensitive drum 1Y with a laser beam having a predetermined intensity based on image printing data. As a result of this write processing, an electrostatic latent image is printed on the photosensitive drum 1Y. This electrostatic latent image is developed by the developing unit 4Y with Y toner. The Y image developed with this Y toner is transferred onto the intermediate transfer belt 6. Toner images of the respective colors are superposed into a color image on the intermediate transfer belt 6. The color image is transferred from the intermediate transfer belt 6 onto a paper sheet.

The flow then advances to step B6 to check whether or not there is a next print to be made, in the print operation mode. In the correction mode, it is checked whether or not there is another correction image to be printed. If there is a next print to be made or another correction operation to be performed, the flow returns to step B3 to repeat the above processing. If it is determined in step B6 that there is no next print to be made or another correction operation to be performed, the flow advances to step B7 to execute termination processing. In this termination processing, the apparatus enters the standby state after the lapse of a predetermined period of time. Alternatively, the image printing control is terminated upon detection of power-off information.

According to the conventional color image printing apparatus 200, after the control unit 15 rotates the intermediate transfer belt 6, photosensitive drum 1Y, registration rollers 23, fixing roller, and the like at rotational speeds set in consideration of a vertical magnification adjustment value in step B2 in FIG. 4, it is checked in step B3 whether the correction operation mode or print operation mode is selected by the control unit 15. Therefore, the following problems arise.

In the image correction operation mode as well, in which no image is actually printed on a paper sheet, since the intermediate transfer belt 6 and photosensitive drum 1Y are rotated in accordance with a vertical magnification adjustment value set in consideration of a predetermined paper quality and size, a toner image (correction image) which is made larger than the image to be actually printed on a paper sheet in consideration of image reduction is printed on the intermediate transfer belt 6 every time.

Consequently, a correction image such as a patch image becomes undesirably large in the correction operation mode, and the consumption of toner becomes always larger to the extent that the correction image becomes larger.

In addition, since a correction image is formed larger in the longitudinal direction of the intermediate transfer belt 6 than in the transverse direction, it takes a longer time for the correction image to pass under each sensor. This may hinder attempts to speed up the read timing correction processing of the Dmax sensor 12. This therefore may cause a deterioration in the correction precision of the read timing of the sensor system or hinder attempts to increase the precision in correcting the magnification of an image in the vertical direction.

SUMMARY OF THE INVENTION

The present invention has been made to solve the above inconveniences in the prior art, and has as its object to provide an image printing method and apparatus which can accurately correct the read timing of a sensor system which is used to correct the position of a toner image in the correction operation mode, and can accurately correct the magnification of an image in the vertical direction in the print operation mode.

In order to achieve the above object, according to the first aspect of the present invention, there is provided an image printing apparatus which prints an image on a desired paper sheet, comprising an image printing unit which has an image printing member and prints a toner image on the image printing member, and a control unit which controls a rotational speed of the image printing member by detecting the toner image printed on the image printing member by the image printing unit, wherein letting a rotating direction of the image printing member be a vertical direction, a first vertical magnification adjustment value be a value for adjusting a magnification of a toner image in the vertical direction which is printed on the image printing member, and a second vertical magnification adjustment value be a value for adjusting a magnification of an image in the vertical direction which is printed on the paper sheet, the control unit executes feedback control on the rotational speed of the image printing member on the basis of the first vertical magnification adjustment value when a first mode of printing a toner image on the image printing member and correcting the image printing system is selected, and executes feedback control on the rotational speed of the image printing member on the basis of the first vertical magnification adjustment value and the second vertical magnification adjustment value when a second mode of printing an image on a paper sheet by operating the image printing system is selected.

According to the second embodiment of the present invention, there is provided an image printing apparatus further comprising a selecting unit which selects the first mode or the second mode in the first aspect.

According to the third aspect of the present invention, there is provided an image printing apparatus, wherein the selecting unit in the second aspect selects the first mode on the basis of a cumulative operating time or/and image printing count of the image printing unit.

According to the fourth aspect of the present invention, in the image printing apparatus described in the third aspect, when the operating time or/and image printing count of the image printing unit has not reached a control target value, and the second mode is selected by the selecting unit, the control unit monitors whether the operating time or/and image printing count of the image printing unit has reached the control target value, and controls the selecting unit to select the first mode if the operating time or/and image printing count of the image printing unit has exceeded the control target value.

According to the fifth aspect of the present invention, the image printing apparatus described in the third aspect apparatus further comprises a first detection unit which detects a positional offset of a toner image printed on the image printing member, and a second detection unit which is placed at a position offset from a position of the first detection unit by a predetermined distance in the vertical direction and detects a density of a toner image printed on the image printing member, and when the first mode is executed, the control unit computes a detection timing of a toner image at the second detection unit on the basis of a timing when the toner image is detected by the first detection unit.

According to the sixth aspect of the present invention, in the image printing apparatus described in the fifth aspect, letting A be a distance from a position of a toner image at a time when the toner image is printed on the image printing member to a position of the first detection unit, LS be a rotational speed of the image printing member, and Ta be a detection timing of a toner image at the first detection unit, Ta=A/LS and, letting B be a distance from the position of the first detection unit to a position of the second detection unit, and Tb be a detection timing of a toner image at the second detection unit, Tb=Ta+B/LS.

According to the seventh aspect of the present invention, there is provided an image printing method of printing, on a desired paper sheet, an image printed on an image printing member of an image printing system, wherein letting a rotating direction of the image printing member be a vertical direction, a first vertical magnification adjustment value be a value for adjusting a magnification of a toner image in the vertical direction which is printed on the image printing member, and a second vertical magnification adjustment value be a value for adjusting a magnification of an image in the vertical direction which is printed on the paper sheet, feedback control on the rotational speed of the image printing member is executed on the basis of the first vertical magnification adjustment value when a toner image is printed on the image printing member to correct the image printing system, and feedback control on the rotational speed of the image printing member is executed on the basis of the first vertical magnification adjustment value and the second vertical magnification adjustment value when a toner image is printed on a paper sheet by operating the image printing system.

According to the image printing apparatus of the present invention, when an image is to be printed on a desired paper sheet, the image printing unit having the image printing member prints a toner image on the image printing member. The control unit detects the toner image printed on the image printing member by the image printing unit, and controls the rotational speed of the image printing member. The apparatus is based on this premise. When, for example, the selecting unit selects the first mode (correction operation mode), without stopping the machine, on the basis of the cumulative operating time or/and image printing count of the image printing unit, the control unit executes feedback control on the rotational speed of the image printing member on the basis of the first vertical magnification adjustment value in order to correct the image printing system by printing a toner image on the image printing member.

At this time, for example, the first detection unit detects the positional offset of the toner image printed on the image printing member. The density of the toner image printed on the image printing member is detected by the second detection unit which is placed at a position offset from the position of the first detection unit by a predetermined distance in the vertical direction. The control unit computes the detection timing of a toner image at the second detection unit on the basis of the timing when the toner image is detected by the first detection unit.

When the first mode is terminated, and the second mode (print operation mode) is selected by the selecting unit, the control unit executes feedback control on the rotational speed of the image printing member on the basis of the first and second vertical magnification adjustment values in order to print an image on a paper sheet by operating the image printing system.

In the first mode, the image printing member can be rotated on the basis of only the first vertical magnification adjustment value independent of a value for adjusting the vertical magnification of an image printed on a paper sheet as in the second mode. This makes it possible to accurately correct the read timing of the sensor system including the first and second detection units and the like, which are used to correct the position of a toner image, so as to eliminate the mechanical assembly tolerance or the like of the image printing unit.

In addition, since a patch image to be printed to read the density of a toner image can be printed small, the correction time can be shortened, and the consumption of toner in correction operation can be reduced.

In the second mode, the image printing member can be rotated on the basis of the second vertical magnification adjustment value in addition to the rotational speed conditions provided for the sensor system or image printing member having undergone accurate timing correction in the first mode. This makes it possible to accurately adjust the magnification of an image in the vertical direction so as to correct image reduction which sometimes occurs depending on the type or size of paper sheet. Therefore, the image on a paper sheet which is obtained from the image printing unit can be matched with a target image print size, thereby printing a high-quality image.

According to the image printing method of the present invention, when an image is to be printed on a desired paper sheet, the image printing member can be rotated in the first mode on the basis of only the first vertical magnification adjustment value independent of a value for adjusting the vertical magnification of an image printed on a paper sheet as in the second mode. This makes it possible to accurately correct the read timing of the sensor system including the first and second detection units and the like which are used to correct the position of a toner image.

In the second mode, the image printing member can be rotated on the basis of the second vertical magnification adjustment value in addition to the sensor system whose timing is accurately corrected in the first mode and the rotational speed conditions for the image printing member. This makes it possible to accurately adjust the magnification of an image in the vertical direction so as to correct image reduction which may occur depending on the type or size of paper sheet.

As is obvious from the respective aspects and effects described above, the present invention can be very suitably applied to a color digital copying machine, multifunction apparatus, and the like which print a color image based on color image information and output it.

The above and many other objects, features and advantages of the present invention will become manifest to those skilled in the art upon making reference to the following detailed description and accompanying drawings in which a preferred embodiment incorporating the principle of the present invention is shown by way of illustrative examples.

BRIEF DESCRIPTION OF THE DRAWINGS

FIGS. 2A and 2B are views showing an example of vertical magnification adjustment (first example) for a toner image in the conventional color image printing apparatus;

FIGS. 3A and 3B are views showing another example of vertical magnification adjustment (second example) for a toner image in the conventional color image printing apparatus;

DETAILED DESCRIPTION OF THE PREFERRED EMBODIMENT

An image printing method and apparatus according to a preferred embodiment of the present invention will be described below with reference to the accompanying drawings.

Figure 1:
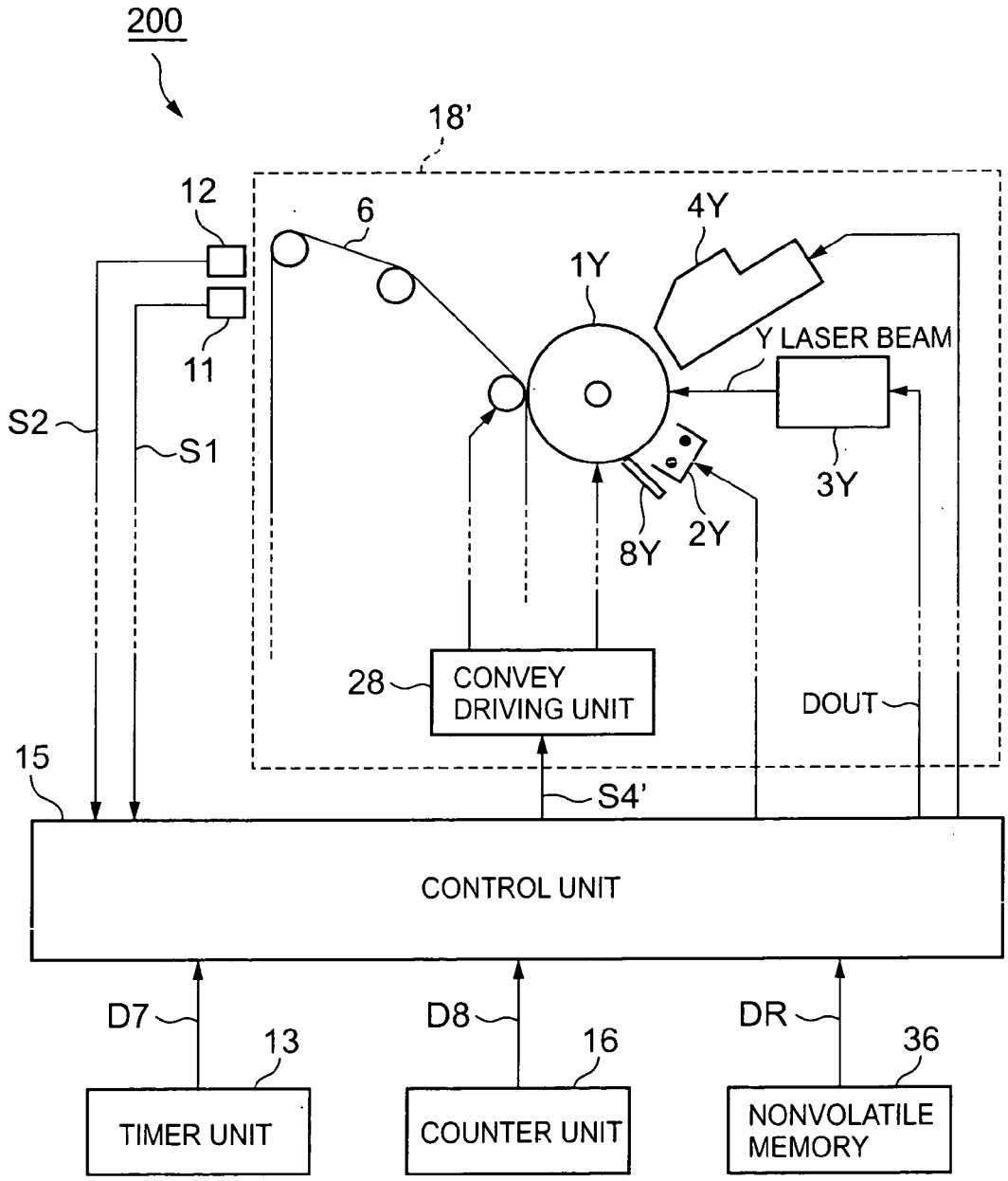
FIG. 1 PRIOR ART
FIG. 1 is a block diagram showing the schematic arrangement of a conventional color image printing apparatus.
Figure 4:
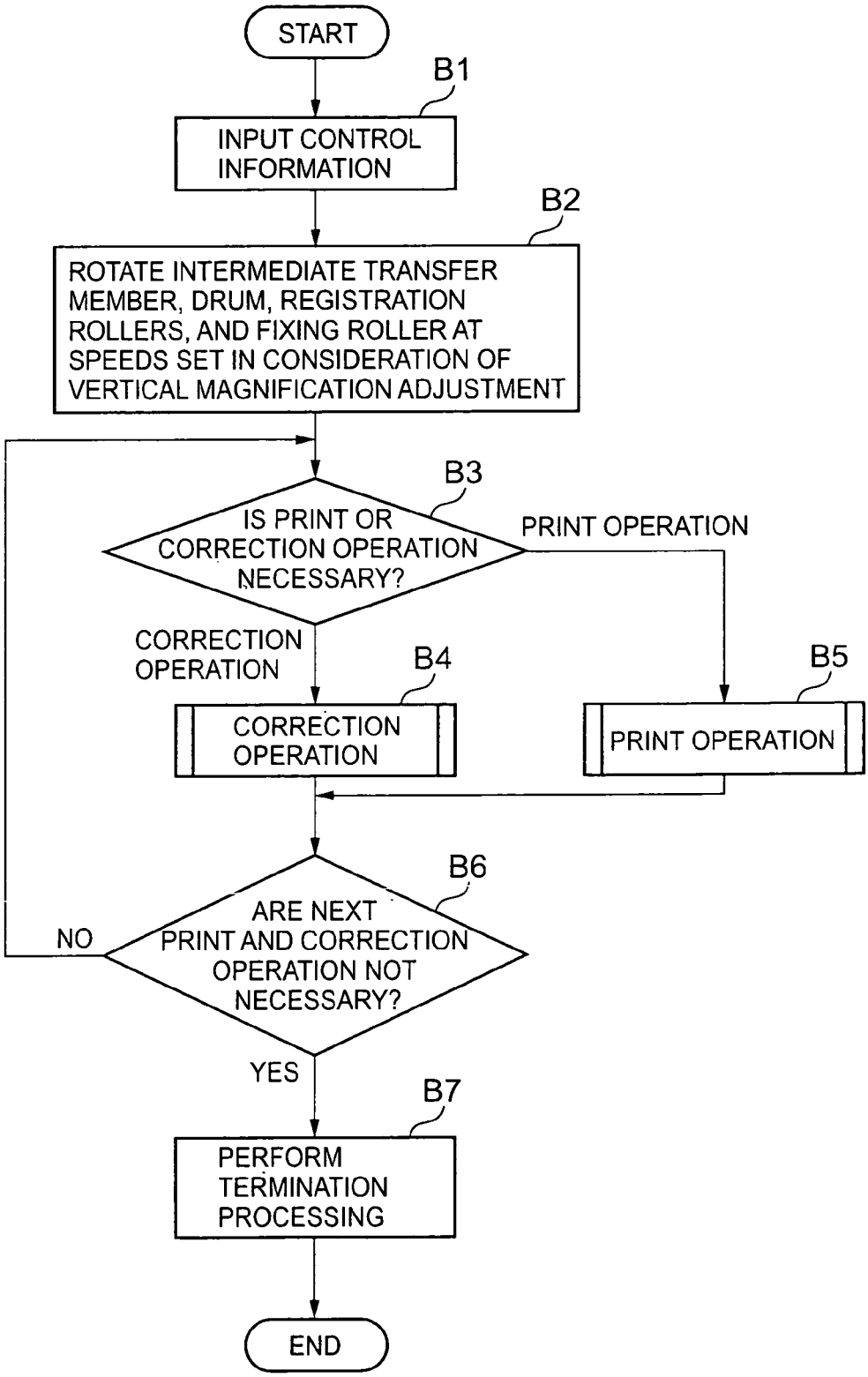
FIG. 4 PRIOR ART
FIG. 4 is a flow chart showing an example of the operation of the conventional color image printing apparatus.
Figure 5:
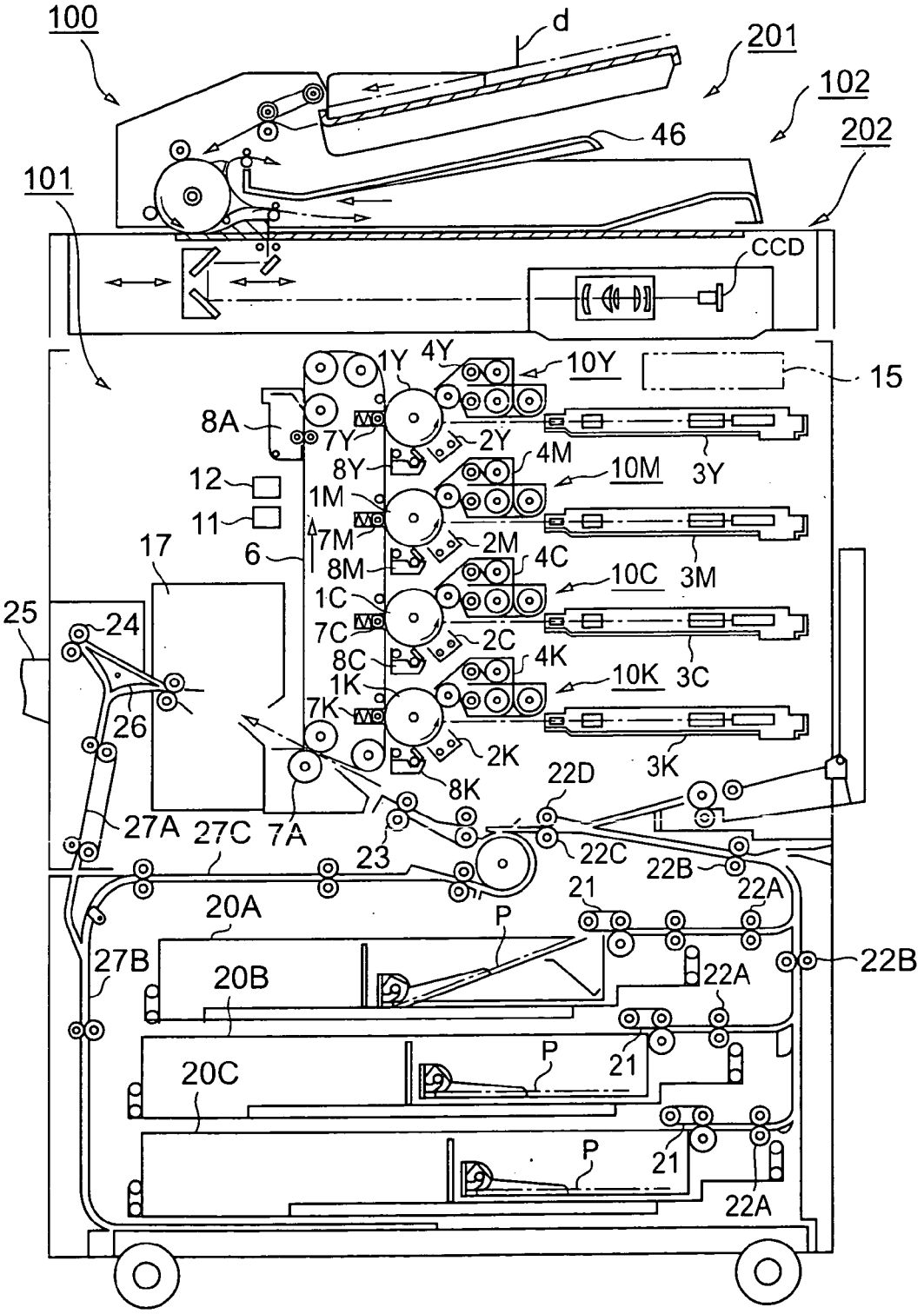
FIG. 5 is a conceptual view showing the schematic arrangement of a color digital copying machine to which an image printing apparatus as an embodiment of the present invention is applied.

FIG. 5 is a conceptual view showing the schematic arrangement of a color digital copying machine 100 to which an image printing apparatus as an embodiment of the present invention is applied.

This embodiment includes a control unit which controls the rotational speed of an image printing member upon detecting a toner image printed on the image printing member when an image is to be printed on a desired paper sheet. When the first mode (to be referred to as a correction operation mode hereinafter) for the image printing member is selected, the control unit executes feedback control on the rotational speed of the image printing member on the basis of the first vertical magnification adjustment value. When the second mode (to be referred to as a print operation mode hereinafter) is selected, the control unit executes feedback control on the rotational speed of the image printing member on the basis of the first and second vertical magnification adjustment values. With this operation, in the first mode, the read timing of a sensor system used to correct the position of a toner image can be accurately corrected, while in the second mode, the magnification of an image in the vertical direction can be accurately corrected.

The color digital copying machine 100 shown in FIG. 5 is an apparatus which prints a color image on a desired paper sheet by superposing colors on the basis of arbitrary image information. Referring to FIG. 5, the color digital copying machine 100 is comprised of an image printing apparatus body 101 and image reading device 102. The image reading device 102 constituted by an automatic document feeder 201 and original image scanning exposure device 202 is placed on the upper portion of the image printing apparatus body 101. A document d placed on the document table of the automatic document feeder 201 is conveyed by a convey unit. The images on side or two sides of the document are scanned/exposed by the optical system of the original image scanning exposure device 202 and captured by a line image sensor CCD.

The analog signal photoelectrically converted by the line image sensor CCD is subjected to analog processing, A/D conversion, shading correction, image compression processing, and the like in an image processing unit (not shown). The resultant image information is then sent to image writing units (exposure units) 3Y, 3M, 3C, and 3K as image printing units.

The automatic document feeder 201 includes an automatic two-sided document convey unit. The automatic document feeder 201 continuously reads the contents of many documents d fed from on the document table all at once and stores the document contents in a storage unit (electronic RDH function). This electronic RDH function is conveniently used to copy the contents of a multipage document by using the copy function or to transmit a multipage document d by using the facsimile function.

The image printing apparatus body 101 is called a tandem color digital copying machine, and includes a plurality of image printing units 10Y, 10M, 10C, and 10K constituting an image printing unit, an endless intermediate transfer belt 6 serving as an intermediate transfer member forming an image forming member, a paper feed/convey unit including a paper re-feed mechanism (ADU mechanism), and a fixing device 17 for fixing a toner image.

The image printing unit 10Y which prints a yellow (Y) image includes a photosensitive drum 1Y forming an image printing member, a Y charging unit 2Y placed around the photosensitive drum 1Y, an exposure unit 3Y, a developing unit 4Y, and a cleaning unit 8Y for an image printing member. The image printing unit 10M which prints a magenta (M) image includes a photosensitive drum 1M serving as an image printing member, an M charging unit 2M, an exposure device 3M, a developing unit 4M, and a cleaning unit 8M for an image printing member.

The image printing unit 10C which prints a cyan (C) image includes a photosensitive drum 1C serving as an image printing member, a C charging unit 2C, an exposure unit 3C, a developing unit 4C, and a cleaning unit 8C for an image printing member. The image printing unit 10K which prints a black (BK) image includes a photosensitive drum 1K serving as an image printing member, a BK charging unit 2K, an exposure unit 3K, a developing unit 4K, and a cleaning unit 8K for an image printing member.

The charging unit 2Y and exposure unit 3Y, the charging unit 2M and exposure device 3M, the charging unit 2C and exposure unit 3C, and the charging unit 2K and exposure device 3K constitute latent image printing units, respectively. Each of the developing units 4Y, 4M, 4C, and 4K performs reversal development by applying a development bias obtained by superposing an AC voltage on a DC voltage having the same polarity as the toner polarity (negative polarity in this embodiment). The intermediate transfer belt 6 is wound around a plurality of rollers to be pivotally supported.

An outline of an image printing process will be described below. The images of the respective colors printed by the image printing units 10Y, 10M, 10C, and 10K are sequentially transferred onto the pivoting intermediate transfer belt 6 (primary transfer) by primary transfer rollers 7Y, 7M, 7C, and 7K to each of which a primary transfer bias (not shown) having a polarity (positive polarity in this embodiment) opposite to that of the toner in use, thereby printing a superposed color image (color toner image). The color image is transferred from the intermediate transfer belt 6 onto a paper sheet P.

The paper sheets P stored in paper feed cassettes 20A, 20B, and 20C are fed by pickup rollers 21 and paper feed rollers 22A respectively provided for the paper feed cassettes 20A, 20B, and 20C, and conveyed to secondary transfer rollers 7A through convey rollers 22B, 22C, and 22D, registration rollers 23, and the like. As a consequence, the color image is transferred onto one surface (upper surface) of the paper sheet P at once (secondary transfer).

The paper sheet P on which the color image is transferred is subjected to fixing processing in the fixing device 17. The paper sheet is then clamped between delivery rollers 24 and placed onto a delivery tray 25 outside the machine. The residual toner left on the surface of each of the photosensitive drums 1Y, 1M, 1C, and 1K after transfer is cleaned by a corresponding one of the cleaning units 8Y, 8M, 8C, and 8K. The next image printing cycle is then started.

When images are to be printed on the two sides of the paper sheet P, the paper sheet P which has an image printed on one surface (upper surface) and is delivered from the fixing device 17 is branched off from a paper sheet delivery path by a branching unit 26. The paper sheet P then passes through a lower circulating paper path 27A, and is inverted by an inversion convey path 27B as a paper re-feed mechanism (ADU mechanism). The paper sheet P then passes through a re-feed convey unit 27C and merges with the normal path at paper feed rollers 22D.

The inverted/conveyed paper sheet P passes through the registration rollers 23 and is conveyed to the secondary transfer rollers 7A again. As a consequence, a color image (color toner image) is transferred onto the other surface (lower surface) of the paper sheet P at once. The paper sheet P on which the color image has been transferred is subjected to fixing processing in the fixing device 17 (or a fixing device 17A). The resultant paper sheet is clamped between the delivery rollers 24 and delivered onto the delivery tray 25 outside the machine.

After the color image is transferred onto the paper sheet P by the secondary transfer rollers 7A, a cleaning unit 8A for the intermediate transfer belt removes the residual toner from the intermediate transfer belt 6 which has curvature-separated the paper sheet P. In these image printing operations, it is preferable that thin paper sheets of about 52.3 to 63.9 kg/m$^2$ (1,000 sheets), plain paper sheets of about 64.0 to 81.4 kg/m$^2$ (1,000 sheets), thick paper sheets of about 83.0 to 130.0 kg/m$^2$ (1,000 sheets), or very thick paper sheets of about 150.0 kg/m$^2$ (1,000 sheets) be used as the paper sheets P, the linear velocity be set to about 80 to 350 mm/sec, and a temperature of about 5 to 35° C. and a humidity of about 15 to 85% be set as environmental conditions. As the paper sheet P, a paper sheet having a thickness (paper thickness) of about 0.05 to 0.15 mm is used.

A color registration sensor 11 as an example of the first detection unit is placed on the left side of the intermediate transfer belt 6 on the upstream side of the cleaning unit 8A described above. The color registration sensor 11 detects the positional shift of a toner image (e.g., a patch image or color registration mark) printed on the intermediate transfer belt 6 and generates a position detection signal S1. The Dmax sensor 12 as an example of the second detection unit is placed at a position offset from the position of the color registration sensor 11 by a predetermined distance in the sub-scanning direction (vertical direction). The Dmax sensor 12 detects the density of a toner image (color image) printed on the intermediate transfer belt 6, and generates a density detection signal S2.

The image printing apparatus body 101 has a control unit 15. When the correction operation mode is executed, the control unit 15 computes the detection timing of a toner image at the Dmax sensor 12 on the basis of the timing when the toner image is detected by the color registration sensor 11. The control unit 15 performs color registration mark detection processing by using the position detection signal S1 and density detection signal S2 based on the computed detection timing.

In this case, the color registration mark detection processing is the processing of printing a color registration mark for color registration on the intermediate transfer belt 6 and detecting the position (e.g., the edge or the center of gravity) of the color registration mark printed on the intermediate transfer belt 6 by using the color registration sensor 11. This processing is performed to adjust the printing position of a color image on the basis of the position of a color registration mark.

Figure 6:
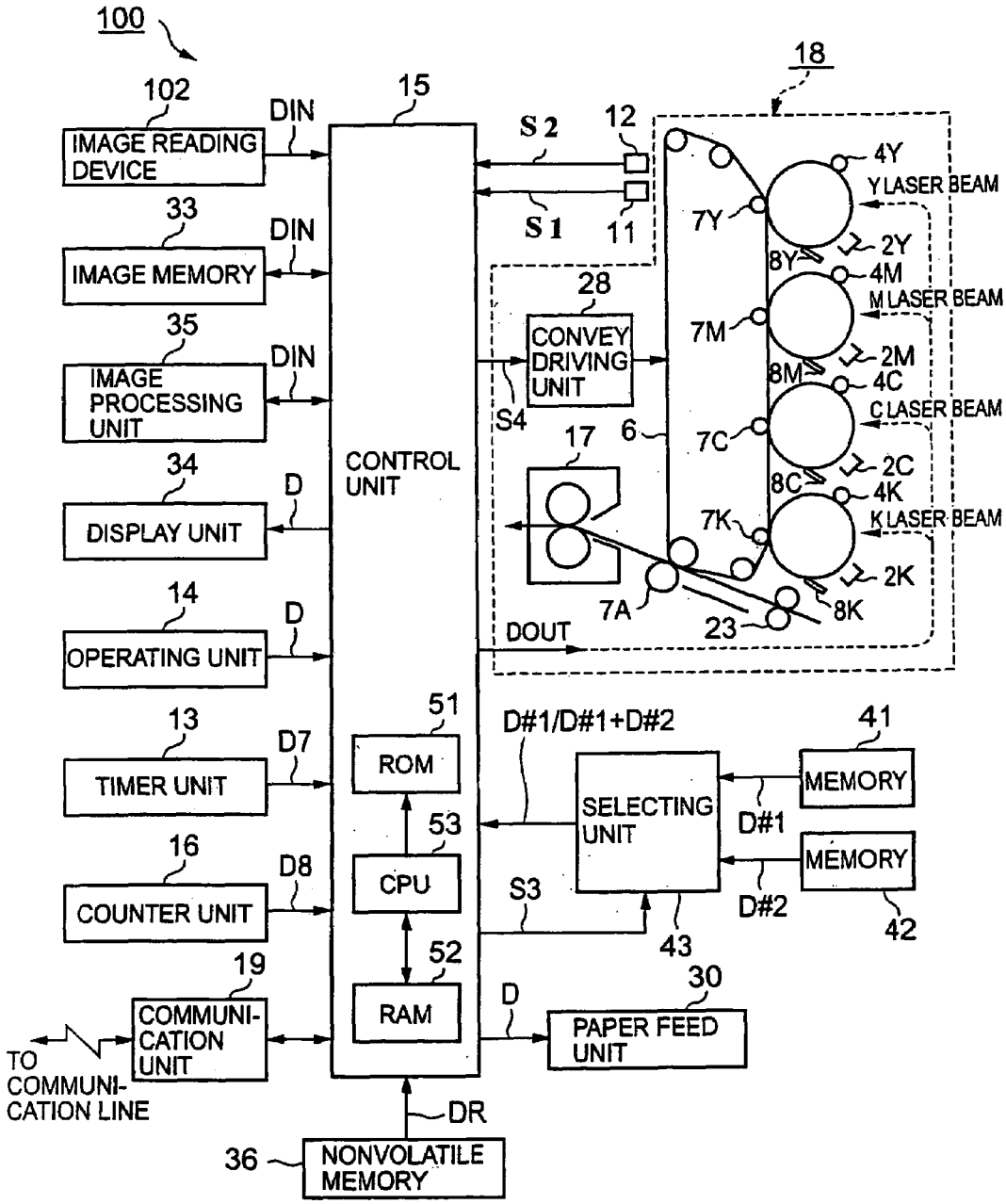
FIG. 6 is a block diagram showing the arrangement of a control system in the color digital copying machine shown in FIG. 5.

FIG. 6 is a block diagram showing the arrangement of a control system in the color digital copying machine 100. The color digital copying machine 100 shown in FIG. 6 has a vertical magnification adjusting mechanism for images, and is designed to print an image on a desired paper sheet. The copying machine 100 includes at least the color registration sensor 11, the Dmax sensor 12, a timer unit 13, a counter unit 16, an image printing unit 18, a convey driving unit 28, and a selecting unit 43.

The control unit 15 includes a ROM (Read Only Memory) 51, RAM (Random Access Memory) 52, and CPU (Central Processing Unit) 53. The ROM 51 stores system program data for controlling the overall image printing apparatus. The RAM 52 is used as a work memory, and is used to temporarily store, for example, a control command. When power is turned on, the CPU 53 reads out system program data from the ROM 51 and starts the system, thereby controlling the overall image printing apparatus on the basis of operation data D3 from an operating unit 14.

The image printing unit 18 having the intermediate transfer belt 6 described with reference to FIG. 5 is connected to the control unit 15. With this arrangement, in correction operation, for example, a toner image such as a patch image or color registration mark is printed on the intermediate transfer belt 6, while in printer operation, a toner image is printed on the basis of arbitrary image data. The image printing unit 18 has the convey driving unit 28, and drives the intermediate transfer belt 6, the photosensitive drums 1Y, 1M, 1C, and 1K, agitating units (not shown) in the developing units 4Y, 4M, 4C, and 4K, and the like on the basis of a driving control signal S4.

The color registration sensor 11 is connected to the control unit 15. The color registration sensor 11 detects, for example, the positional shift of a toner image such as a patch image or color registration mark printed on the intermediate transfer belt 6, and outputs the position detection signal S1 to the control unit 15. The position detection signal S1 obtained from the color registration sensor 11 is used for color image position correction (color registration correction) in the correction operation mode.

The Dmax sensor 12 is connected to the control unit 15, in addition to the color registration sensor 11, to detect the density of a toner image printed on the intermediate transfer belt 6 and output the density detection signal S2 to the control unit 15. The density detection signal S2 obtained from the Dmax sensor 12 is used for maximum density correction (Dmax correction), grayscale density correction (ã correction), or the like. The copying machine 100 has a plurality of sensors other than the color registration sensor 11 and Dmax sensor 12.

The selecting unit 43 is connected to the control unit 15. The selecting unit 43 is controlled to select the correction operation mode (first mode) or print operation mode (second mode) on the basis of a selection control signal S3. Two memories 41 and 42 are connected to the selecting unit 43. The selection control signal S3 is output from the control unit 15 to the selecting unit 43. The selection control signal S3 is a signal for selecting the contents stored in the memory 41 in the correction operation mode. This signal is used to select the contents stored in the memory 41 or 42 in the print operation mode.

In this case, the correction operation mode is the operation of printing a toner image on the intermediate transfer belt 6 and correcting the image printing system. The print operation mode is the operation of printing an image on a paper sheet by operating the image printing system. The selecting unit 43 is controlled to select the correction operation mode on the basis of the cumulative operating time and/or image printing count of the image printing unit 18.

The memory 41 stores first vertical magnification adjustment value data D#1 which is a value for adjusting the vertical magnification of a correction image (toner image) printed on the intermediate transfer belt 6 when the rotating direction of the intermediate transfer belt 6 is defined as the vertical direction (sub-scanning direction). The memory 42 stores second vertical magnification adjustment value data D#2 which is a value for adjusting the vertical magnification of an image printed on a paper sheet. The vertical magnification adjustment value data D#2 varies depending on the paper type, size, and thickness. As each of the memories 41 and 42, an EEPROM (Electrically Erasable Programmable Read Only Memory) 36 or ROM (Read Only Memory) is used.

In this case, the first vertical magnification adjusting/setting unit is constituted by the control unit 15, image printing unit 18, selecting unit 43, and memory 41. Likewise, the second vertical magnification adjusting/setting unit is constituted by the control unit 15, image printing unit 18, selecting unit 43, and memory 42. In this case, the intermediate transfer belt 6 is rotated at the rotational speed set in consideration of both the first vertical magnification adjusting/setting unit and the second vertical magnification adjusting/setting unit based on paper reduction. In this case, the second vertical magnification adjusting/setting unit includes a drum, registration rollers, and a fixing roller.

That is, the copying machine 100 includes the two-stage vertical magnification adjusting/setting unit constituted by the first and second vertical magnification adjusting/setting units. This machine has the correction operation mode (first mode) based on only the first vertical magnification adjusting/setting unit and the print operation mode (second mode) based on both the first and second vertical magnification adjusting/setting units. These two modes are switched without stopping the image printing mechanism (machine). In the correction operation mode, therefore, the control unit 15 rotates the intermediate transfer belt 6 in consideration of only the first vertical magnification adjusting/setting unit. In the print operation mode, the control unit 15 rotates the intermediate transfer belt 6 in consideration of both the first and second vertical magnification adjusting/setting units.

In this case, if the operating time, image printing count, or the like of the image printing unit 18 does not reach a control target value DR, i.e., the print operation mode is selected by the selecting unit 43 (this state will be referred to as a normal case), the control unit 15 monitors whether or not the operating time of the image printing unit 18 has reached the control target value DR set in advance. If the operating time of the image printing unit 18 has exceeded the control target value DR, the control unit 15 controls the selecting unit 43 to select the correction operation mode.

The control target value DR is stored in, for example, the nonvolatile memory 36. The timer unit 13 is connected to the control unit 15 to measure the operating time of the image printing unit 18. Operating time data D7 obtained by this measurement is also stored in the nonvolatile memory 36 or the like. This timer may be mounted in the control unit 15. The control unit 15 accumulates (adds) the operating time of the image printing unit 18. The operating time data D7 accumulated here is used to determine the necessity of correction operation.

Obviously, the present invention is not limited to this. For example, it is monitored whether the image printing count of the image printing unit 18 has reached the preset control target value DR. If the image printing count has exceeded the control target value DR, the selecting unit 43 may be controlled to select the correction operation mode. In this case, the counter unit 16 is connected to the control unit 15 to measure the image printing count of the image printing unit 18. Image printing count data D8 obtained by this measurement may be stored in the nonvolatile memory 36. The control unit 15 accumulates (adds) the image printing count of the image printing unit 18. The image printing count data D8 accumulated here can be used to determine the necessity of correction operation. The counter unit 16 may be mounted in the control unit 15.

The control unit 15 detects a toner image printed on the intermediate transfer belt 6 by the image printing unit 18, and controls the rotational speed of the intermediate transfer belt 6. If, for example, the correction operation mode is selected by the selecting unit 43, the control unit 15 executes feedback control on the rotational speed of the intermediate transfer belt 6 on the basis of the vertical magnification adjustment value data D#1. This feedback control is executed to drive the intermediate transfer belt 6 at a rotational speed equal to the design value.

The process linear velocity as the design value of the intermediate transfer belt 6 can be switched in steps. For example, the process linear velocity can be switched to 1/2 velocity and 1/3 velocity with respect to the standard linear velocity (1/1 velocity). If the standard linear velocity is 220 mm/s, the process linear velocity can be switched to 110 mm/s as 1/2 linear velocity and 73 mm/s as 1/3 linear velocity.

In this correction operation mode, an elapsed time (data) is calculated on the basis of the distance from a laser irradiation position on the photosensitive drum 1Y to the color registration sensor 11 and the linear velocities of the photosensitive drum 1Y and intermediate transfer belt 6, or an elapsed time from the start time of exposure of a patch image, grayscale image, or the like to the detection timing is calculated. The difference between the elapsed times is then obtained to correct a sensor positional shift or correct the read timing of the Dmax sensor 12. In addition, the density of a toner image on the intermediate transfer belt 6 is measured by the Dmax sensor 12 after correction. On the basis of this measurement result, the control unit 15 corrects, for example, the amount of charging by the charging unit 2Y for the Y image printing system or the laser power (Y laser) in the exposure unit 3Y. Similar corrections are made for the remaining M, C, and BK image printing systems.

In executing this correction operation mode, if the intermediate transfer belt 6 shown in FIG. 5 does not rotate at a linear velocity equal to the design value, a detection timing error occurs when the Dmax sensor 12 reads a correction image such as a patch image. In order to match the rotational speed of the intermediate transfer belt 6 with the design value, therefore, the intermediate transfer belt 6 is rotated at the rotational speed based on the preset vertical magnification adjustment value data D#1. This makes it possible to accurately read a patch image or grayscale image printed on the intermediate transfer belt 6 to perform color registration correction or the like.

Likewise, when the print operation mode is selected, feedback control on the rotational speed of the intermediate transfer belt 6 is executed on the basis of vertical magnification adjustment value data D#1 and vertical magnification adjustment value data D#2 (to be referred to as D#1+D#2 hereinafter). In this print operation mode, the intermediate transfer belt 6 is driven at the linear velocity based on D#1+D#2 without operating the color registration sensor 11 or Dmax sensor 12 or loading the detection signal S1 or S2. This is because importance is placed on an image on a sheet that is printed out.

Note that the image reading device 102, an image memory 33, a display unit 34, an image processing unit 35, the operating unit 14, a paper feed unit 30, and a communication unit 19 are connected to the control unit 15, in addition to the color registration sensor 11, Dmax sensor 12, timer unit 13, counter unit 16, image printing unit 18, convey driving unit 28, and selecting unit 43.

The image reading device 102 reads, for example, a color original, and outputs original image data DIN associated with R (Red), G (Green), and B (Blue). The image processing unit 35 performs image processing such as shading correction or ã correction for the original image data DIN associated with R, G, and B. The original image data DIN image-processed by the image processing unit 35 is stored in the image memory 33.

In the print operation mode, the display unit 34 displays image printing conditions and the like on the basis of display data D5. The operating unit 14 is operated to set image printing conditions in the print operation mode. Operation data D3 set by using the operating unit 14 is output to the control unit 15. A GUI (Graphical User Interface) operation panel constituted by a touch panel and liquid crystal display monitor is used for the operating unit 14 and display unit 34.

The communication unit 19 is connected to a communication line such as a LAN and is used for communication processing with an external computer or the like. When the copying machine 100 is to be used as a printer, the communication unit 19 is used to receive print data from an external computer in the print operation mode.

The paper feed unit 30 controls the paper feed cassettes 20A, 20B, and 20C shown in FIG. 5 on the basis of paper feed control data D4. For example, the paper feed unit 30 drives the pickup rollers 21 and paper feed rollers 22A provided for the paper feed cassette 20A to pick up the paper sheet P stored in the paper feed cassette 20A and feed it to the image printing unit 18. The paper feed control data D4 is supplied from the control unit 15.

Figure 7:
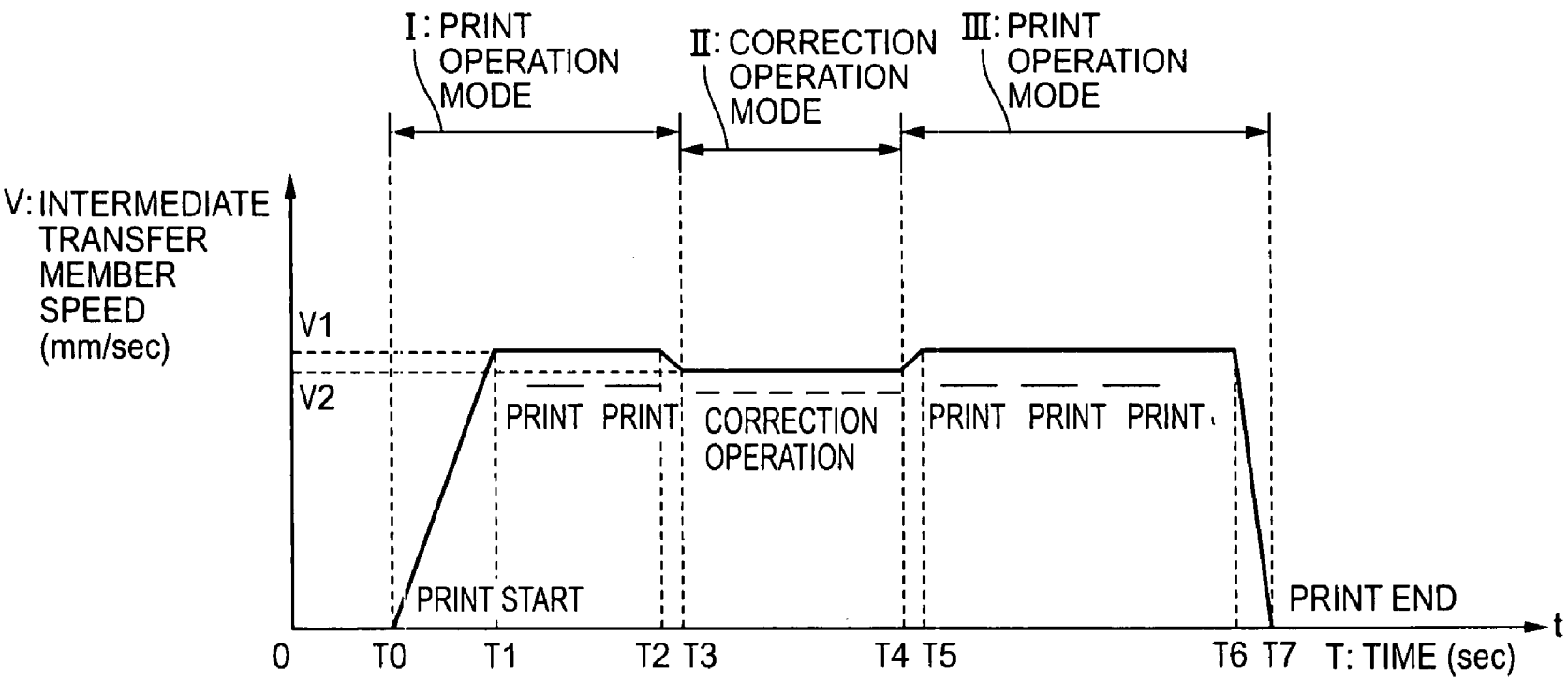
FIG. 7 is a timing chart showing an example of the operation of the color digital copying machine shown in FIG. 5.

FIG. 7 is a timing chart showing an example of the operation of the color digital copying machine 100. Referring to FIG. 7, the ordinate represents the rotational speed of the intermediate transfer belt 6 (intermediate transfer member speed) V [mm/sec]; and the abscissa, an operating time T [sec]. The solid-line curve represents a case wherein the correction operation mode is executed in the process of executing the print operation mode in the copying machine 100. Reference symbol I denotes a print operation mode; II, a correction operation mode; and III, a print operation mode.

According to an example of the operation of the digital copying machine 100 in FIG. 7, in the print operation mode I, print operation is started at time T0, and print operation is executed at time T1. In this case, the intermediate transfer member speed is V2 [m/sec]. The control unit 15 rotates the intermediate transfer belt 6 at a rotational speed set in consideration of both the vertical magnification adjustment value data D#1 and D#2. That is, the convey driving unit 28 drives the intermediate transfer belt 6, photosensitive drums 1Y, 1M, 1C, and 1K, developing units 4Y, 4M, 4C, and 4K, registration rollers 23, fixing roller, and the like on the basis of the driving control signal S4 set in consideration of the vertical magnification adjustment value data D#1+D#2 and supplied from the control unit 15.

In this print operation mode, the intermediate transfer belt 6 is driven at the linear velocity based on D#1+D#2 without operating the color registration sensor 11 or Dmax sensor 12 or loading the position detection signal S1 or density detection signal S2. For example, two prints are output at time T2 upon taking the time (T2−T1).

In this case, the correction operation mode II is selected in place of the print operation mode I at time T3, and correction operation is executed at time T3. In this correction operation, for example, printing of a patch image or the like and read correction on the sensor system are executed by taking the time (T4−T3). At this time, the intermediate transfer member speed is V1 [mm/sec], which is set under the relationship of V1<V2. The control unit 15 rotates the intermediate transfer belt 6 at a rotational speed set in consideration of only the vertical magnification adjustment value data D#1.

That is, the convey driving unit 28 drives the intermediate transfer belt 6, photosensitive drums 1Y, 1M, 1C, and 1K, developing units 4Y, 4M, 4C, and 4K, registration rollers, fixing roller, and the like on the basis of the driving control signal S4 set in consideration of only the vertical magnification adjustment value data D#1 from the control unit 15, i.e., the driving control signal S4 set without consideration of the vertical magnification adjustment value data D#2.

At time T4, the print operation mode III is selected in place of the correction operation mode II. At time T5, print operation is resumed. For example, three prints are output at time T6 upon taking the time (T6−T5). At time T7, the print operation mode III is terminated. In this manner, the correction operation mode can be executed during the execution of the print operation mode in the copying machine 100.

Figure 8:
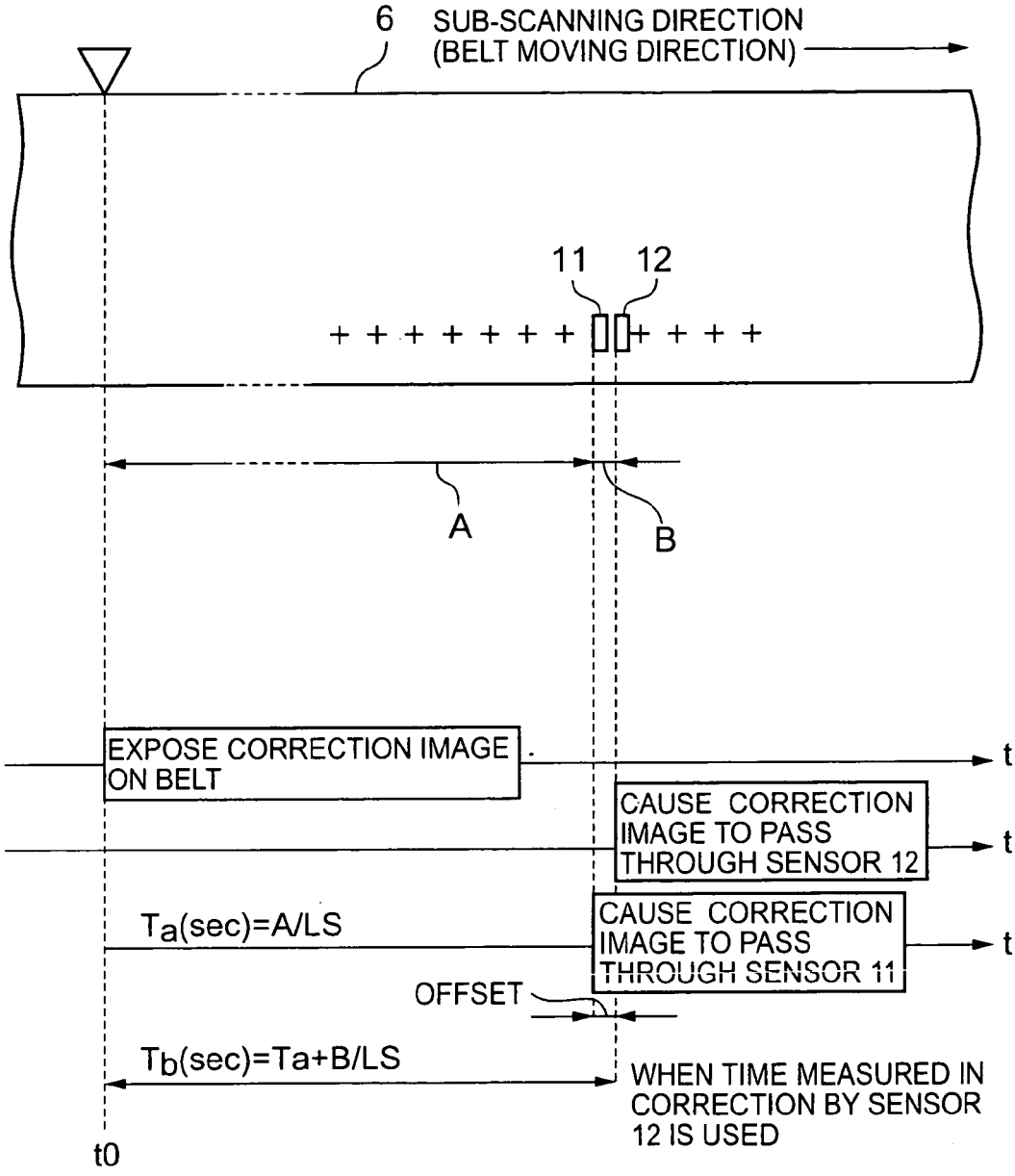
FIG. 8 is a view showing an example of the layout of sensors on an intermediate transfer belt and an example of the detection timing.

An example of a sensor arrangement at the intermediate transfer belt 6 and an example of the detection timing will be described next. FIG. 8 shows an example of the arrangement of the color registration sensor 11 and Dmax sensor 12 in a developed view of the intermediate transfer belt 6, and an example of the detection timing of each of the sensors 11 and 12 in a timing chart.

In this embodiment, the color registration sensor 11 and Dmax sensor 12 are arranged above the intermediate transfer belt 6. In this case, in color registration correction directed to match the printing positions of images of the respective colors (Y, M, C, and BK), color registration patterns for color misregistration detection are exposed on the photosensitive drum 1Y with laser beams of the respective colors.

Referring to FIG. 8, the inverted delta symbol indicates a position on the intermediate transfer belt 6 at which a correction image such as a patch image is exposed. When, for example, the photosensitive drum 1Y is charged by the charging unit 2Y in the image printing unit 10Y, the exposure unit 3Y irradiates the charged photosensitive drum 1Y with a laser beam having a predetermined intensity based on correction image data (write processing for correction image data). As a result of this write processing, an electrostatic latent image forming a correction image is formed on the photosensitive drum 1Y.

This electrostatic latent image is developed by the developing unit 4Y using Y toner. The correction image developed with Y toner is transferred onto the intermediate transfer belt 6 (primary transfer). The correction image on the photosensitive drum 1Y after the primary transfer is removed by the cleaning unit 8Y. The intermediate transfer belt 6 onto which the correction image is transferred is driven by the control unit 15 and convey driving unit, and moves below the mount area of the color registration sensor 11 and Dmax sensor 12. The convey driving unit 28 drives the intermediate transfer belt 6, photosensitive drums 1Y, 1M, 1C and 1K, developing units 4Y, 4M, 4C, and 4K, registration rollers, convey rollers, and the like on the basis of the driving control signal S4 from the control unit 15.

The Dmax sensor 12 shown in FIG. 8 is placed at a position offset from the position of the color registration sensor 11 by a predetermined distance B in the sub-scanning direction (the moving direction of the belt; vertical direction). The Dmax sensor 12 detects the density of a correction image printed on the intermediate transfer belt 6, and outputs the density detection signal S2 to the control unit 15. The Dmax sensor 12 and color registration sensor 11 are offset from each other in order to make the color registration sensor 11 and Dmax sensor 12 detect correction images serially printed in the sub-scanning direction under the same image printing conditions.

Feedback control on the irradiation timings of laser beams is performed in the exposure units 3Y, 3M, 3C, and 3K and the like. A time Ta measured in this case includes the offset from the laser irradiation position to the color registration sensor 11. If, therefore, a detection timing Ta of a correction image obtained in execution of color registration correction by using the color registration sensor 11 is used as the read timing of the Dmax sensor 12, the offset from the laser irradiation position to the color registration sensor 11 can be canceled out. When density correction is executed by using the Dmax sensor 12, the read timing of the Dmax sensor 12 can be adjusted in accordance with the detection timing Ta.

In this case, when the correction operation mode is executed, the control unit 15 computes the detection timing of a toner image at the Dmax sensor 12 on the basis of the timing when the toner image is detected by the color registration sensor 11. Letting A be the distance from the printing position of the correction image indicated by the inverted delta symbol, which corresponds to exposure time t0 in FIG. 8, LS be the rotational speed of the intermediate transfer belt 6, and Ta be the detection timing of a correction image at the color registration sensor 11, the detection timing Ta can be obtained by $$Ta=A/LS \tag{1}$$

Letting B be the distance between the position of the color registration sensor 11 and the Dmax sensor 12, and Tb be the detection timing of a correction image at the Dmax sensor 12, the timing Tb is obtained by $$Tb=Ta+B/LS \tag{2}$$

This makes it possible to adjust the read timing of the Dmax sensor 12 with the detection timing Ta in executing density correction using the Dmax sensor 12 by using the detection timing Ta of a correction image at the Dmax sensor 12 which is obtained by the color registration sensor 11 in executing color registration correction.

FIGS. 9A to 9D are operation timing charts showing an example of the detection timing of a correction image at each of the sensors 11 and 12. In this case, with reference to a system clock CLK shown in FIG. 9A, a Y laser beam or the like is radiated at rise time (exposure time) t0 of the system clock CLK shown in FIG. 9B, and a correction image is detected by the color registration sensor 11 at a rise time t1 of the system clock CLK shown in FIG. 9C. The difference between time t1 and exposure time t0 corresponds to the detection timing Ta computed by equation (1).

Figures 9A, 9B, 9C, 9D:
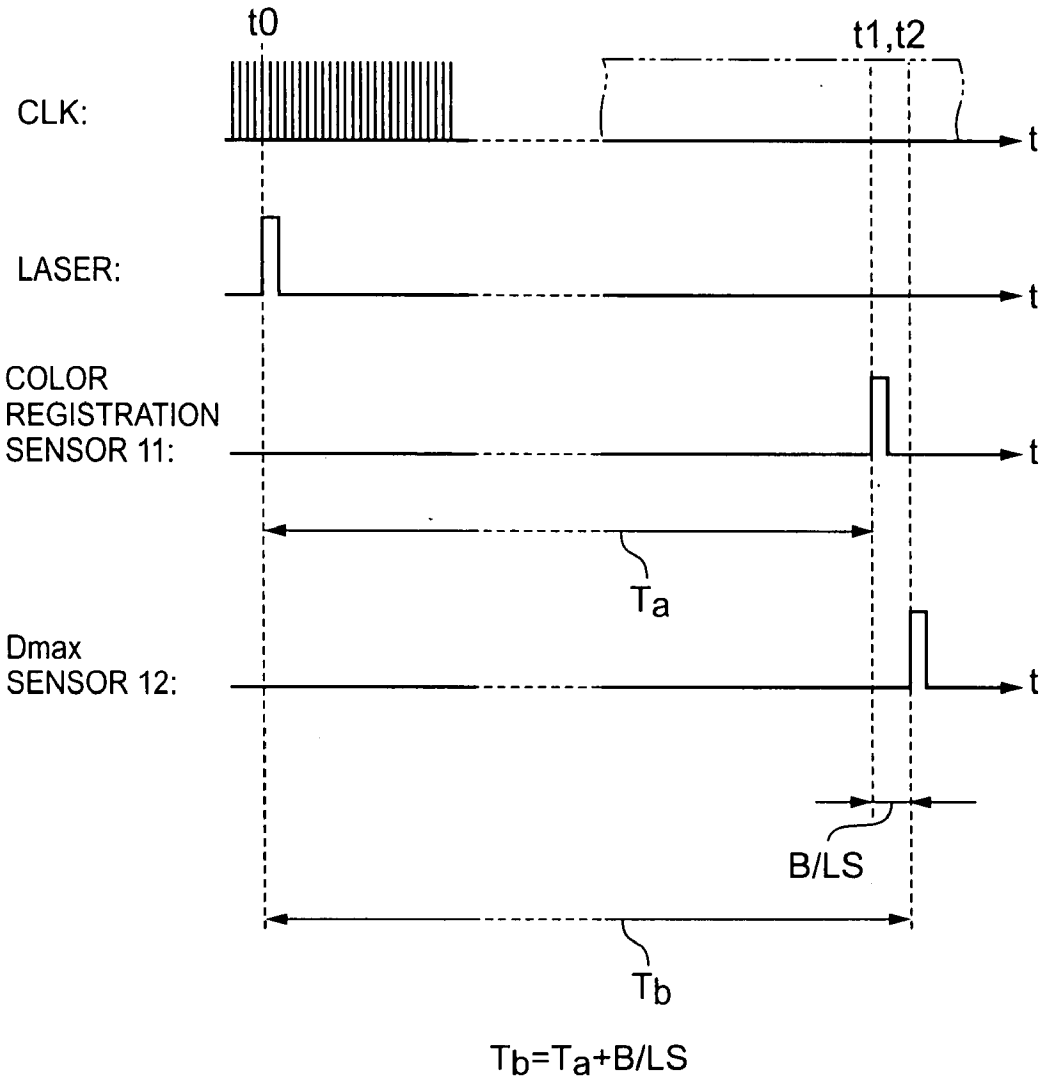
FIGS. 9A to 9D are operation timing charts showing all example of the detection timing of a correction image at each of sensors 11 and 12.

At time t2 shown in FIG. 9D, the correction image is detected by the Dmax sensor 12. The difference between time t2 and exposure time t0 corresponds to the detection timing Tb of the correction image, which is computed from equation (1) and the offset amount B/LS between the color registration sensor 11 and the Dmax sensor 12 according to equation (2).

That is, only the detection offset time B/LS between the color registration sensor 11 and the Dmax sensor 12 remains, and mechanical errors such as the assembly tolerance of an image printing mechanism which is detected by the color registration sensor 11 can be canceled out. This makes it possible to improve the precision of the read timing of the Dmax sensor 12 or the like. As the distance (1/2) from a laser irradiation position on the photosensitive drum (a transfer position on the intermediate transfer belt 6) to the mount position of each sensor increases, the proportion of an offset factor increases as compared with an error B in the distance between the color registration sensor 11 and the Dmax sensor 12. This leads to a further improvement in the read timing precision. The Dmax sensor 12 can therefore read the density of an image at a more accurate detection timing.

Figure 10:
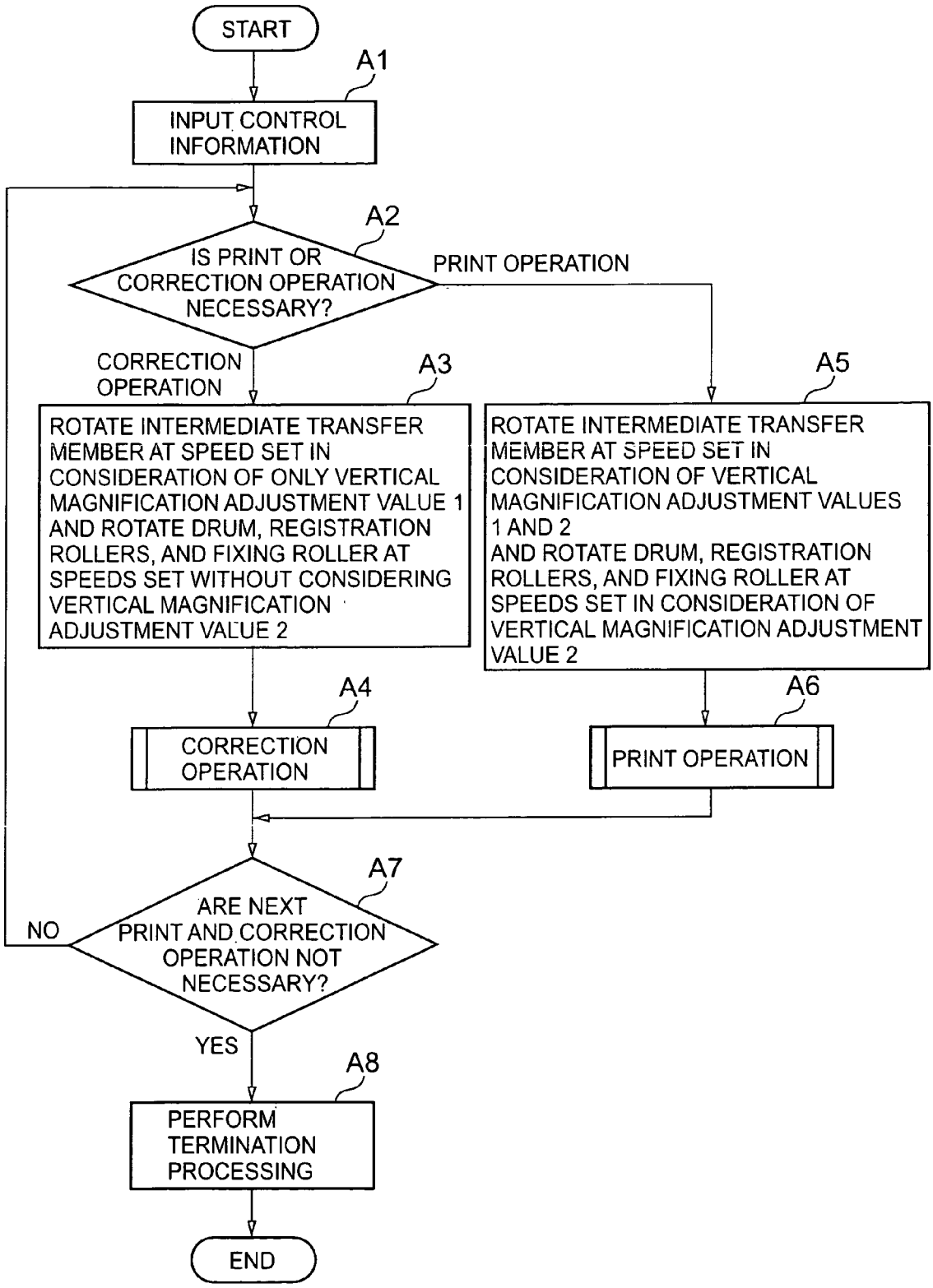
FIG. 10 is a flow chart showing an example of the operation of the color digital copying machine shown in FIG. 5 in each mode.

An example of the operation of the color digital copying machine 100 will be described next. FIG. 10 is a flow chart showing an example of the operation in each mode in the color digital copying machine 100.

This embodiment is based on the premise that an image printed on the intermediate transfer belt 6 in the image printing system is printed on a desired paper sheet. In this case, when a correction image is to be printed on the intermediate transfer belt 6 so as to correct the image printing system, feedback control on the rotational speed of the intermediate transfer belt 6 is executed on the basis of the vertical magnification adjustment value data D#1. When an image is to be printed on a paper sheet by operating the image printing system, feedback control on the rotational speed of the intermediate transfer belt 6 is executed on the basis of the vertical magnification adjustment value data D#1+D#2. Obviously, the copying machine 100 is kept on. Assume that in this case, the printer operation mode has been selected.

Under these processing conditions, control information is input (output) from the timer unit 13, counter unit 16, or the like to the control unit 15 in step A1 in the flow chart shown in FIG. 10. This control information is used to determine the necessity of the correction operation mode and includes the operating time data D7 or image printing count data D8 of the image printing unit 18. The control unit 15 receives, for example, the operating time data D7 from the timer unit 13, and monitors whether or not the operating time of the image printing unit 18 has reached the preset control target value DR.

In step A2, the control unit 15 checks whether the correction operation mode or print operation mode is selected. At this time, the control unit 15 reads out the control target value DR from the nonvolatile memory 36, and compares the operating time data D7 obtained from the timer unit 13 with the control target value DR. If this comparison result indicates that the operating time of the image printing unit 18 has exceeded the control target value DR, the control unit 15 outputs the selection control signal S3 to the selecting unit 43 to select the correction operation mode. At this time, the control unit 15 outputs the selection control signal S3 for selecting the contents stored in the memory 41 to the selecting unit 43.

If the correction operation mode is selected, the flow advances to step A3, in which the control unit 15 rotates the intermediate transfer belt 6 at a rotational speed set in consideration of only the vertical magnification adjustment value data D#1. The flow then advances to step A4 to execute correction operation. At this time, the convey driving unit 28 drives the intermediate transfer belt 6, photosensitive drums 1Y, 1M, 1C, and 1K, developing units 4Y, 4M, 4C, and 4K, registration rollers, fixing roller, and the like on the basis of the driving control signal S4 set in consideration of only the vertical magnification adjustment value data D#1, i.e., the driving control signal S4 set without consideration of the vertical magnification adjustment value data D#2.

In this correction operation mode, an elapsed time (data) is calculated from the distance A from the laser irradiation position (inverted delta symbol) shown in FIG. 8 to the color registration sensor 11 and the linear velocity of the intermediate transfer belt 6, or the elapsed times Ta and Tb from exposure start time t0 for a patch image, grayscale image, or the like to times t1 and t2 are calculated by equations (1) and (2). In addition, the detection timing based on a sensor position offset is detected to correct the read timing of the Dmax sensor 12. Furthermore, the density of a correction image on the intermediate transfer belt 6 is measured by the Dmax sensor 12 after correction.

On the basis of this measurement result, the control unit 15 corrects the amount of charging by the charging unit 2Y for the Y image printing system or the laser power in the exposure unit 3Y. The flow then advances to step A7. Similar corrections are made for the remaining M, C, and BK image printing systems.

If the print operation mode is selected in step A2, the flow advances to step A5, in which the control unit 15 rotates the intermediate transfer belt 6 at a rotational speed set in consideration of both the vertical magnification adjustment value data D#1 and D#2. The flow then advances to step A6 to execute print operation. At this time, the convey driving unit 28 drives the intermediate transfer belt 6, photosensitive drums 1Y, 1M, 1C, and 1K, developing units 4Y, 4M, 4C, and 4K, registration rollers 23, fixing roller, and the like on the basis of the driving control signal S4 set in consideration of the vertical magnification adjustment value data D#2 from the control unit 15. In this print operation mode, the intermediate transfer belt 6 is driven at the rotational speed based on D#1+D#2 without operating the color registration sensor 11 or Dmax sensor 12 or loading the position detection signal S1 or density detection signal S2.

The images of the respective colors printed by the image printing units 10Y, 10M, 10C, and 10K are sequentially transferred onto the pivoting intermediate transfer belt 6 (primary transfer) by the primary transfer rollers 7Y, 7M, 7C, and 7K to each of which a primary transfer bias having a polarity opposite to that of the toner in use, thereby printing a superposed color image (color toner image). The color image is transferred from the intermediate transfer belt 6 onto the paper sheet P.

For example, in the paper feed unit 30, a paper sheet is picked up from the paper feed cassette 20A by the pickup rollers 21 and paper feed rollers 22A provided for the paper feed cassette 20A, and conveyed to the secondary transfer rollers 7A through convey rollers 22B, 22C, and 22D, registration rollers 23, and the like. As a consequence, the color image is transferred onto one surface (upper surface) of the paper sheet P at once (secondary transfer).

The paper sheet P on which the color image is transferred is subjected to fixing processing in the fixing device 17. The paper sheet is then clamped between delivery rollers 24 and placed onto the delivery tray 25 outside the machine. The residual toner left on the surface of each of the photosensitive drums 1Y, 1M, 1C, and 1K after transfer is cleaned by a corresponding one of the cleaning units 8Y, 8M, 8C, and 8K. The next image printing cycle is then prepared.

The flow then advances to step A7. In the print operation mode, it is checked whether or not there is a next print to be output. In the correction operation mode, it is checked whether or not there is another correction image to be printed. If it is determined that there is no next print to be made or another correction operation to be performed, termination processing is executed. In this termination processing, the apparatus enters the standby state after the lapse of a predetermined period of time. Alternatively, the image printing control is terminated upon detection of power-off information. If there is a next print to be made or another correction operation to be performed, the flow returns to step A2 to repeat the above processing.

As described above, according to the color digital copying machine and image printing method according to the embodiment of the present invention, when an image is to be printed on a desired paper sheet, and the correction operation mode is selected by the selecting unit 43 on the basis of the cumulative operating time and/or image printing count of the image printing unit 18, the control unit 15 executes feedback control on the rotational speed of the intermediate transfer belt 6 on the basis of the vertical magnification adjustment value data D#1 without stopping the machine, and corrects the image printing system by printing a correction image on the intermediate transfer belt 6.

In this correction operation mode, the intermediate transfer belt 6 can be rotated on the basis of only the vertical magnification adjustment value data D#1 independent of a value for adjusting the vertical magnification of an image printed on a paper sheet as in the print operation mode. At this time, the positional offset of a toner image printed on the intermediate transfer belt 6 is detected by the color registration sensor 11.

The Dmax sensor 12, which is placed at a position offset from the position of the color registration sensor 11 by a predetermined distance in the vertical direction, detects the density of a toner image printed on the intermediate transfer belt 6. The control unit 15 computes the detection timing of the toner image at the Dmax sensor 12 on the basis of the timing when the toner image is detected by the color registration sensor 11.

In this correction operation mode, the intermediate transfer belt 6 can be rotated on the basis of only the vertical magnification adjustment value data D#1 independent of a value for adjusting the vertical magnification of an image printed on a paper sheet as in the print operation mode. This makes it possible to accurately correct the read timing of the Dmax sensor 12 or the like by using the color registration sensor 11, which is used to correct the position of a toner image, so as to eliminate the assembly tolerance and the like of the image printing unit 18. In addition, since a patch image to be printed to read the density of a correction image can be printed small, the correction time can be shortened, and the consumption of toner accompanying correction operation can be reduced.

When this correction operation mode is terminated, since the print operation mode is selected by the selecting unit 43, an image can be printed on a paper sheet by continuously operating the image printing system without stopping the machine. At this time, the control unit 15 executes feedback control on the rotational speed of the intermediate transfer belt 6 or the like on the basis of the vertical magnification adjustment value data D#1+D#2. The intermediate transfer belt 6 can therefore be rotated on the basis of the vertical magnification adjustment value data D#2 in addition to the sensor system having undergone accurate timing correction in the correction operation mode and the rotational speed condition for the intermediate transfer belt 6. This makes it possible to accurately adjust the magnification of an image in the vertical direction so as to correct image reduction which sometimes occurs depending on the type or size of paper sheet.

In addition, since in the print operation mode, the intermediate transfer belt 6 can be rotated on the basis of the vertical magnification adjustment value data D#2 in addition to the sensor system having undergone accurate timing correction in the correction operation mode and the rotational speed condition for the intermediate transfer belt 6, the magnification of an image in the vertical direction can be accurately adjusted so as to correct image reduction which sometimes occurs depending on the type or size of paper sheet. This can print a high-quality image.

What is claimed is:

1. An image printing apparatus which prints an image on a desired paper sheet, comprising:

image printing means which has an image printing member and prints a toner image on the image printing member; and control means for controlling a rotational speed of the image printing member by detecting the toner image printed on the image printing member by said image printing means, wherein letting a rotating direction of the image printing member be a vertical direction, a first vertical magnification adjustment value be a value for adjusting a magnification of a toner image in the vertical direction which is printed on the image printing member, and a second vertical magnification adjustment value be a value for adjusting a magnification of an image in the vertical direction which is printed on the paper sheet, said control means executes feedback control on the rotational speed of the image printing member on the basis of the first vertical magnification adjustment value when a first mode of printing a toner image on the image printing member and correcting an image printing system is selected, and executes feedback control on the rotational speed of the image printing member on the basis of the first vertical magnification adjustment value and the second vertical magnification adjustment value when a second mode of printing an image on a paper sheet by operating the image printing system is selected.

2. An apparatus according to claim 1, further comprising selecting means for selecting the first mode or the second mode.

3. An apparatus according to claim 2, wherein said selecting means selects the first mode on the basis of a cumulative operating time or/and image printing count of said image printing means.

4. An apparatus according to claim 3, wherein when the operating time or/and image printing count of said image printing means has not reached a control target value, and the second mode is selected by said selecting means, said control means monitors whether the operating time or/and image printing count of said image printing means has reached the control target value, and controls said selecting means to select the first mode if the operating time or/and image printing count of said image printing means has exceeded the control target value.

5. An apparatus according to claim 1, wherein said apparatus further comprises first detection means for detecting a positional offset of a toner image printed on the image printing member, and second detection means which is placed at a position offset from a position of said first detection means by a predetermined distance in the vertical direction and detects a density of a toner image printed on the image printing member, and when the first mode is executed, said control means computes a detection timing of a toner image by said second detection means on the basis of a timing when the toner image is detected by said first detection means.

6. An apparatus according to claim 5, wherein letting A be a distance from a position of a toner image at a time when the toner image is printed on the image printing member to a position of said first detection means, LS be a rotational speed of the image printing member, and Ta be a detection timing of a toner image at said first detection means, $$Ta=A/LS$$

and, letting B be a distance from the position of said first detection means to a position of said second detection means, and Tb be a detection timing of a toner image at said second detection means, $$Tb=Ta+B/LS.$$

7. An image printing method of printing, on a desired paper sheet, an image printed on an image printing member of an image printing system, wherein letting a rotating direction of the image printing member be a vertical direction, a first vertical magnification adjustment value be a value for adjusting a magnification of a toner image in the vertical direction which is printed on the image printing member, and a second vertical magnification adjustment value be a value for adjusting a magnification of an image in the vertical direction which is printed on the paper sheet, feedback control on the rotational speed of the image printing member is executed on the basis of the first vertical magnification adjustment value when a toner image is printed on the image printing member to correct the image printing system, and feedback control on the rotational speed of the image printing member is executed on the basis of the first vertical magnification adjustment value and the second vertical magnification adjustment value when a toner image is printed on a paper sheet by operating the image printing system.

* * * * *